US010273984B2

(12) United States Patent
Veit et al.

(10) Patent No.: US 10,273,984 B2
(45) Date of Patent: Apr. 30, 2019

(54) HYDRAULIC SYSTEM

(71) Applicant: Putzmeister Engineering GmbH, Aichtal (DE)

(72) Inventors: Jan-Martin Veit, Reutlingen (DE); Werner Muenzenmaier, Nuertingen (DE)

(73) Assignee: Putzmeister Engineering GmbH, Aichtal (DE)

( * ) Notice: Subject to any disclaimer, the term of this patent is extended or adjusted under 35 U.S.C. 154(b) by 937 days.

(21) Appl. No.: 14/391,291

(22) PCT Filed: Mar. 20, 2013

(86) PCT No.: PCT/EP2013/055747
§ 371 (c)(1),
(2) Date: Oct. 8, 2014

(87) PCT Pub. No.: WO2013/178373
PCT Pub. Date: Dec. 5, 2013

(65) Prior Publication Data

US 2015/0096290 A1 Apr. 9, 2015

(30) Foreign Application Priority Data

May 31, 2012 (DE) ..... 10 2012 209 142

(51) Int. Cl.
*E02F 9/22* (2006.01)
*F15B 11/17* (2006.01)
(Continued)

(52) U.S. Cl.
CPC ..... *F15B 11/17* (2013.01); *E02F 9/2292* (2013.01); *F04B 9/1178* (2013.01); *F04B 15/02* (2013.01);
(Continued)

(58) Field of Classification Search
CPC ..... F04B 9/1178; F04B 15/02; F04B 49/06; F15B 11/22; F15B 11/17; F15B 13/027; F15B 7/006; F15B 13/06; E02F 9/2292
See application file for complete search history.

(56) References Cited

U.S. PATENT DOCUMENTS 4,073,141 A 2/1978 Lohbauer
4,369,625 A * 1/1983 Izumi ..... E02F 9/2242 414/699
(Continued)

FOREIGN PATENT DOCUMENTS

CN 1788159 A 6/2006
CN 101069018 A 11/2007
(Continued)

OTHER PUBLICATIONS

Chinese Office Action in CN 201380023654.X, dated Nov. 4, 2015.
(Continued)

*Primary Examiner* — Abiy Teka
(74) *Attorney, Agent, or Firm* — Collard & Roe, P.C.

(57) ABSTRACT

A hydraulic system, preferably for actuating and engaging a mobile slurry pump, includes a primary circuit, actuating a first hydraulic consumer, which circuit has a hydraulic drive assembly including at least one motor-driven hydraulic pump. The hydraulic system further includes a secondary circuit, actuating a second hydraulic consumer, which circuit has a second hydraulic drive assembly including at least one additional motor-driven hydraulic pump. In a first operating state, hydraulic oil from a common tank can be admitted to the hydraulic consumers arranged in the primary circuit and in the secondary circuit via the hydraulic drive assemblies thereof, independently of one another. In a second operating state, a portion of the hydraulic oil is supplied from the primary circuit to the secondary circuit to actuate the second consumer.

7 Claims, 8 Drawing Sheets

Figure 1:
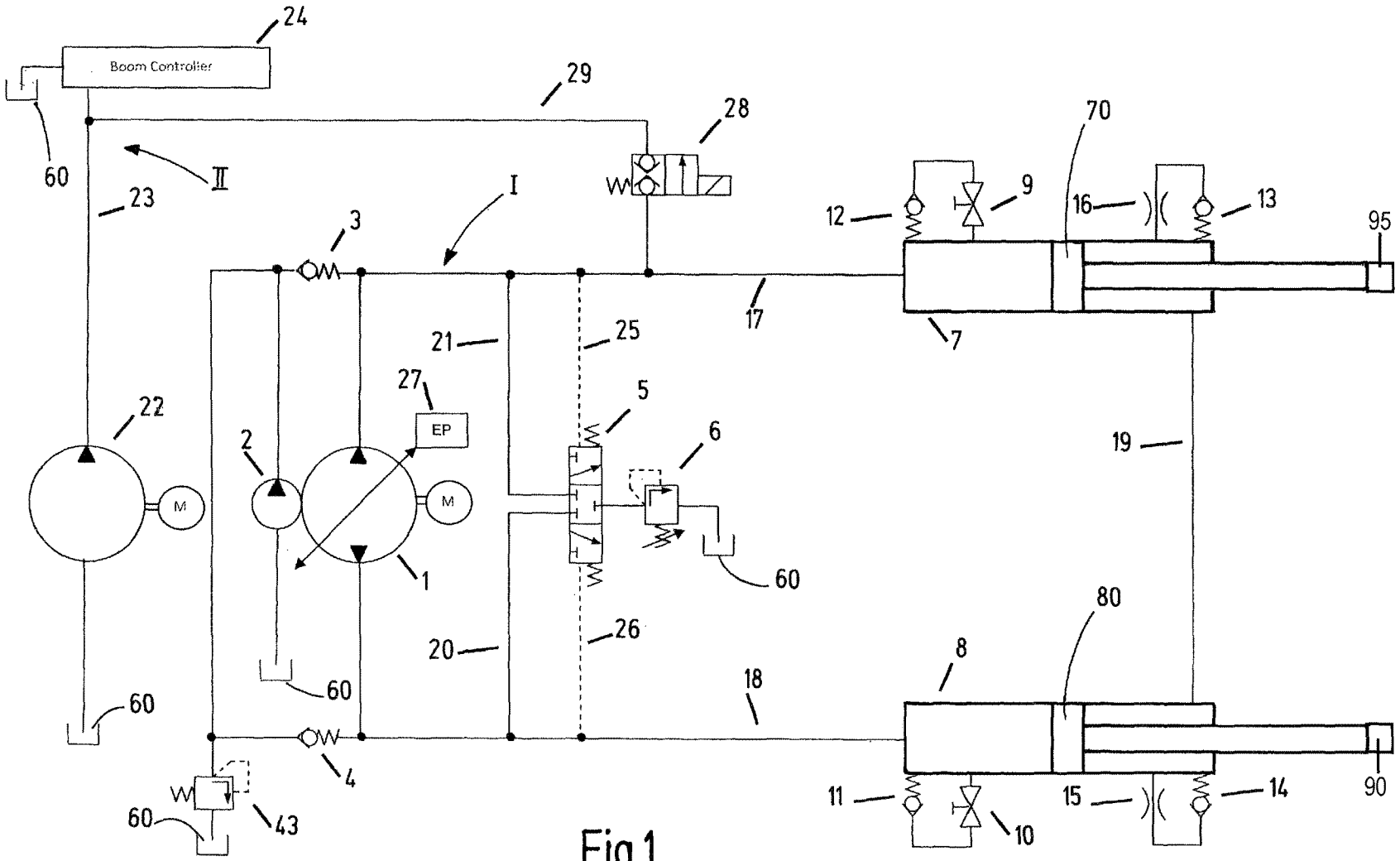

(51) Int. Cl.

| | |
|---|---|
| ***F15B 7/00*** | (2006.01) |
| ***F04B 15/02*** | (2006.01) |
| ***F04B 49/06*** | (2006.01) |
| ***F04B 9/117*** | (2006.01) |
| ***F15B 13/02*** | (2006.01) |
| ***F15B 13/06*** | (2006.01) |

(52) U.S. Cl.

CPC ..... *F04B 49/06* (2013.01); *F15B 7/006* (2013.01); *F15B 13/027* (2013.01); *F15B 13/028* (2013.01); *F15B 13/06* (2013.01); *F15B 2211/20546* (2013.01); *F15B 2211/20561* (2013.01); *F15B 2211/20576* (2013.01); *F15B 2211/26* (2013.01); *F15B 2211/27* (2013.01); *F15B 2211/3059* (2013.01); *F15B 2211/31594* (2013.01); *F15B 2211/4159* (2013.01); *F15B 2211/428* (2013.01); *F15B 2211/613* (2013.01); *F15B 2211/7053* (2013.01); *F15B 2211/7114* (2013.01); *F15B 2211/7121* (2013.01); *F15B 2211/781* (2013.01)

(56) References Cited

U.S. PATENT DOCUMENTS

| | | | | |
|---|---|---|---|---|
| 6,171,075 | B1 | 1/2001 | Muenzenmaier et al. | |
| 6,929,454 | B2 | 8/2005 | Münzenmaier et al. | |
| 7,104,057 | B2 | 9/2006 | Jung | |
| 7,322,802 | B2 * | 1/2008 | Benckert | F04B 15/02 417/399 |
| 7,401,466 | B2 * | 7/2008 | Von Baeumen | F04B 9/1178 60/394 |
| 7,905,088 | B2 * | 3/2011 | Stephenson | E02F 9/2217 60/414 |
| 2006/0245943 | A1 | 11/2006 | Hofmann et al. | |
| 2008/0016862 | A1 | 1/2008 | Von Baumen et al. | |
| 2010/0319335 | A1 | 12/2010 | Schneider et al. | |

FOREIGN PATENT DOCUMENTS

| | | | | |
|---|---|---|---|---|
| DE | 29 607 989 | U1 | 7/1996 | |
| DE | 296 07 989 | U1 | 7/1996 | |
| DE | 10 2005 008 217 | A1 | 8/2006 | |
| DE | 10 2009 029 840 | A1 | 1/2011 | |
| EP | 1 391 639 | B1 | 2/2004 | |
| EP | 1 995 155 | A2 | 11/2008 | |
| GB | 2 251 961 | A | 7/1992 | |
| JP | H0914128 | A | 1/1997 | |
| JP | 2004505191 | A | 2/2004 | |
| JP | H 914128 | A * | 10/2005 | F04B 15/02 |
| JP | 2008531933 | A | 8/2008 | |
| WO | 92/09811 | A1 | 6/1992 | |
| WO | 2005/024246 | A1 | 3/2005 | |

OTHER PUBLICATIONS

International Search Report of PCT/EP2013/055747, dated Jul. 23, 2013.

German Search Report in 10 2012 209 142.4, dated Feb. 7, 2013, with English translation of relevant parts.

* cited by examiner

HYDRAULIC SYSTEM

CROSS REFERENCE TO RELATED APPLICATIONS

This application is the National Stage of PCT/EP2013/055747 filed on Mar. 20, 2013, which claims priority under 35 U.S.C. § 119 of German Application No. 10 2012 209 142.4 filed on May 31, 2012, the disclosure of which is incorporated by reference. The international application under PCT article 21(2) was not published in English.

The invention relates to a hydraulic system, preferably for activating and actuating a mobile thick matter pump, having a primary circuit which activates a first hydraulic consumer and has a first hydraulic drive assembly which comprises at least one motor-driven hydraulic pump, having a secondary circuit which activates a second hydraulic consumer and has a second hydraulic drive assembly which comprises at least one further motor-driven hydraulic pump, the hydraulic consumers which are arranged in the primary circuit and in the secondary circuit being loaded in a first operating state via their hydraulic drive assemblies independently of one another with hydraulic oil from a tank.

Hydraulic systems of this type are used, for example, for activating and actuating mobile thick matter pumps which have a hydraulic drive mechanism for the thick matter pump, which drive mechanism is arranged in the primary circuit, and a hydraulic drive and control mechanism for a distributor boom which is configured, for example, as a folding boom, which drive and control mechanism is arranged in the secondary circuit. In the operating state of a thick matter pump of this type which is preferably configured as a concrete pump, although the drive mechanism of the thick matter pump and that of the distributor boom are actuated simultaneously but independently of one another via their respective hydraulic pumps, the oil supply in the hydraulic circuits being limited in the process by way of the oil quantity which is delivered by the associated hydraulic pumps, there are also operating states, in which only one of the hydraulic circuits is activated. This is the case, for example, before and after pumping operation during unfolding and folding of the distributor boom between a folded-in transport position and a folded-out operating position. In modern concrete pumps, this unfolding and folding operation runs in a program-controlled manner. Since this operation at the same time means a waiting time for the pump driver, there is a requirement for a rapid embodiment which leaves much to be desired with the pump outputs which are usually available in the boom hydraulic circuit, although they are sufficient for normal operation.

Proceeding herefrom, the invention is based on the object of improving the known hydraulic system of the type specified at the outset, in such a way that an increased operating speed is made possible for specific tasks within the hydraulic system in the case of a given pump output in the different hydraulic circuits.

According to the invention, the combination of features described herein is proposed to achieve this. Advantageous refinements and developments of the invention are also described herein.

The object according to the invention is achieved primarily by virtue of the fact that, in a second operating state, when the first consumer is at a standstill, at least part of the hydraulic oil from the primary circuit is fed into the secondary circuit in order to activate the second consumer. By way of this measure, more oil is made available for the operation of the second consumer without an increase in the rotational speed of the motor-driven hydraulic pumps, and therefore a higher output, in particular a higher operating speed, is achieved.

In the case of the application which is preferably taken into consideration of a thick matter pump, the first consumer which is arranged in the primary circuit is expediently configured as a hydraulic drive mechanism of the thick matter pump, whereas the second consumer which is arranged in the secondary circuit is configured as a drive and control mechanism of a distributor boom which consists of a plurality of boom arms. In this case, the measure according to the invention can be used, for example, for the automatic folding and unfolding of the distributor boom, by oil from the main circuit of the thick matter pump being fed to the boom circuit, for example via a suitable valve controller.

According to one preferred embodiment of the invention, the hydraulic drive mechanism of the thick matter pump has two hydraulic drive cylinders which are connected via in each case one piston rod to a delivery cylinder and are connected at their one end via in each case one main line to the at least one hydraulic pump which is arranged in the primary circuit and are connected at their other end via an oil oscillation line to one another, the primary circuit and the secondary circuit being connected to one another via a connecting line, in which a first control valve which selectively releases or shuts off the oil flow is arranged. In order to ensure the build-up of pressure which is required for feeding into the secondary line, at least one second control valve which selectively shuts off or releases the oil flow to the tank is expediently arranged within the primary circuit. One further design variant provides that at least one third control valve which selectively shuts off or releases the oil flow to, from or between the hydraulic cylinders is arranged within the primary circuit.

A further advantageous refinement of the invention provides that at least one reversible and adjustable main pump and a feed pump which opens on the pressure side into the primary circuit and on the suction side into the tank are arranged in the closed primary circuit. In this case, one first design variant provides that the connecting line which contains the control valve is branched off from one of the main lines of the primary circuit. In order that the pressure which is necessary for the boom control can be built up by the main pump, the main pump is activated in this case in such a way that the pressure side of the main pump is at the relevant main line. Accordingly, in this case, the piston of the drive cylinder which is connected to the relevant main line has to be moved into its end position which is adjacent to the oil oscillation line. In a further design variant, the connecting line which contains the control valve is connected via in each case one non-return valve to one of the main lines of the primary circuit. As a result, the main pump can selectively be activated in such a way that the pressure side lies either at the one main line or at the other main line.

Furthermore, a control valve which releases or shuts off the throughflow can be arranged in the oil oscillation line between the hydraulic cylinders. A further advantageous or alternative refinement in this regard can consist in that stroke compensation loops which are fitted with infeed and outfeed valves are arranged in the region of the end positions of the drive cylinders, and in that a control valve which is configured as a shut-off valve or a directional valve which can be connected selectively to the secondary circuit is arranged in at least one of the stroke compensation loops.

Figure 5:
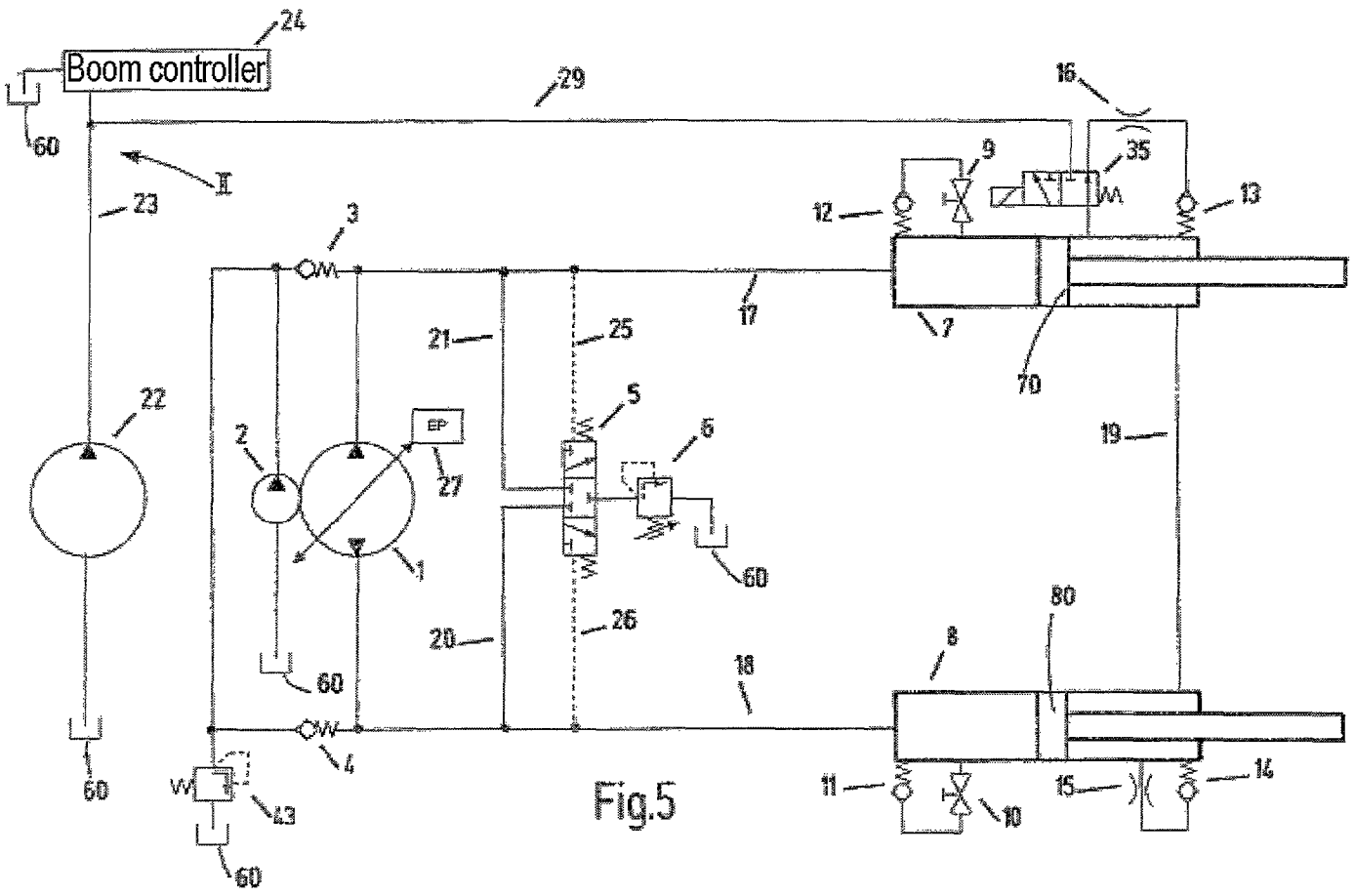
Figure 6:
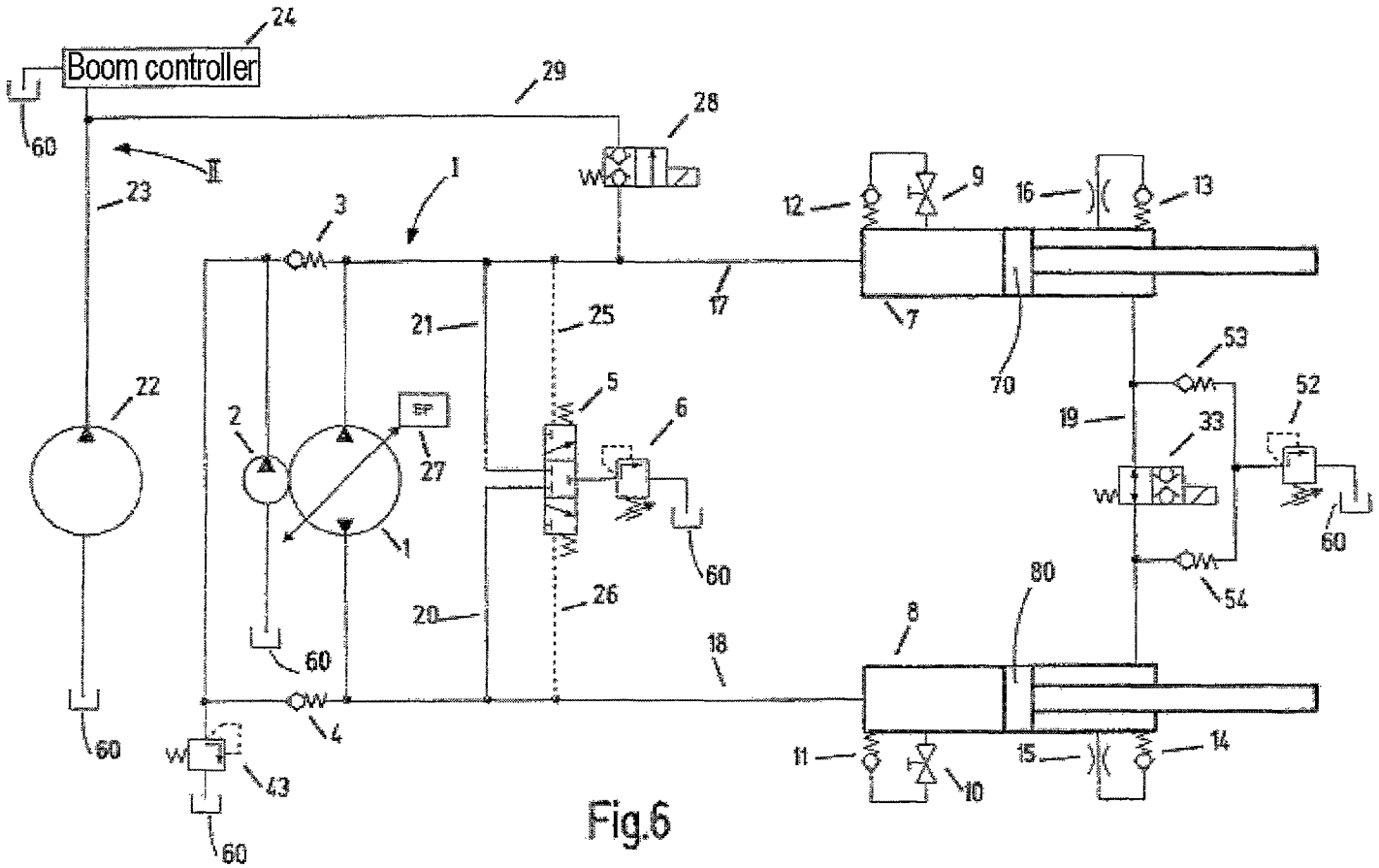
Figure 7:
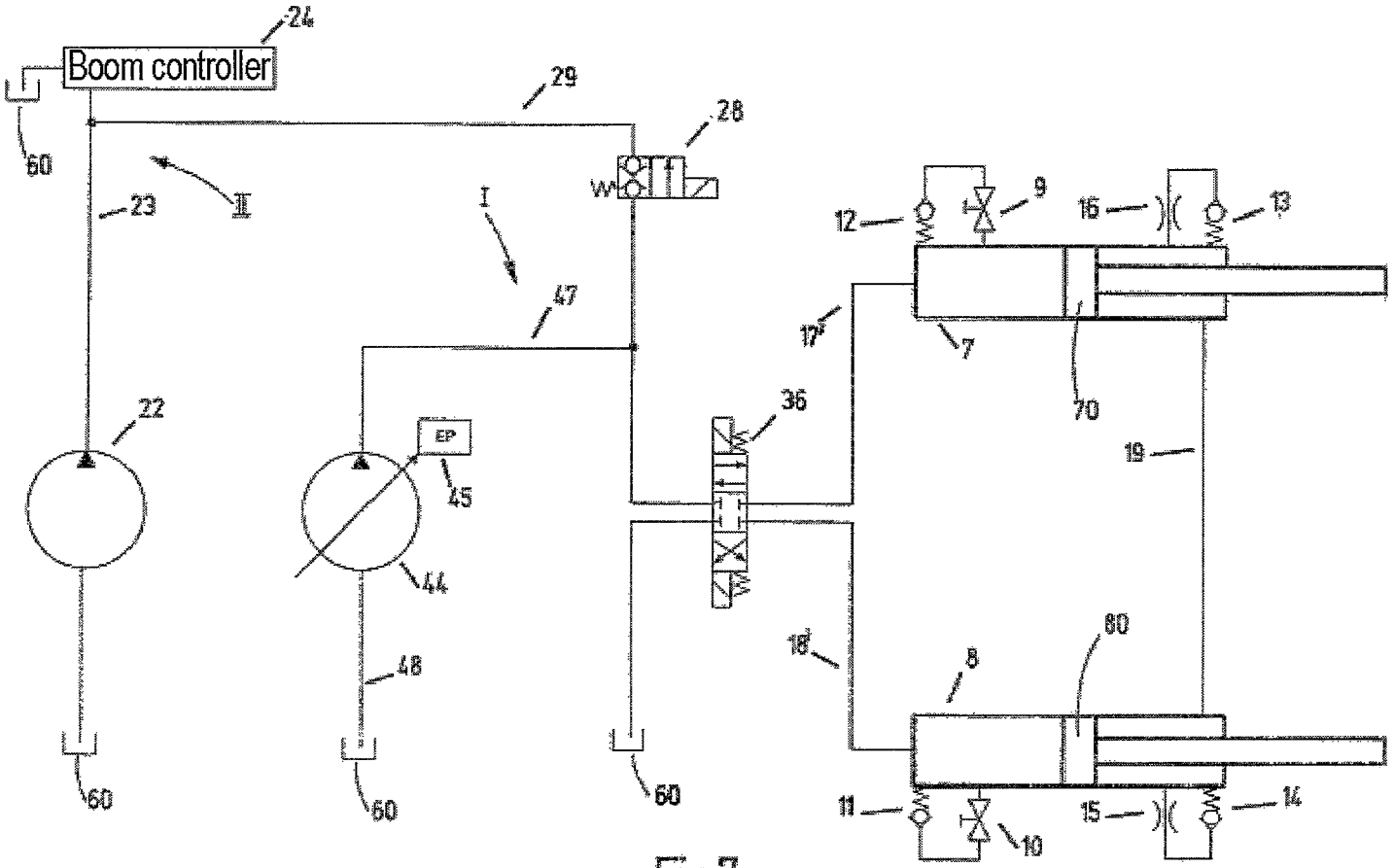
Figure 8:
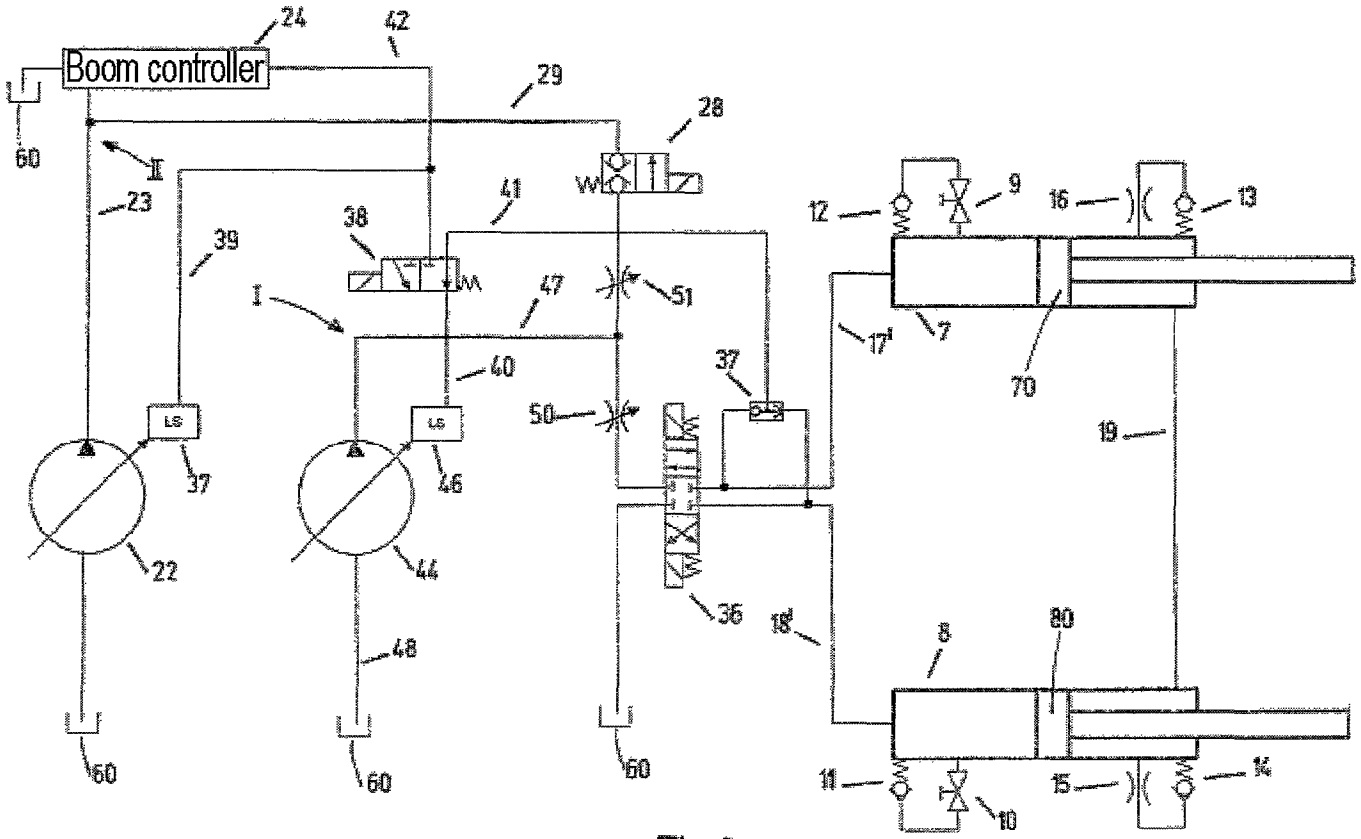

In the following text, the invention will be explained in greater detail using the exemplary embodiments which are shown diagrammatically in the drawing, in which:

FIGS. 1 to 6 show hydraulic circuit arrangements of hydraulic systems having a closed primary circuit for actuating a two-cylinder thick matter pump and a secondary circuit for the control of a distributor boom, and FIGS. 7 and 8 show hydraulic circuit arrangements of hydraulic systems having an open primary circuit for activating and actuating a two-cylinder thick matter pump and having a secondary circuit for the control of a distributor boom.

The hydraulic circuits which are shown in the drawing are intended for thick matter pumps which have two delivery cylinders 90, 95, the end-side openings of which open into a material supply container and can be connected alternately during the pressure stroke via a transfer tube to a delivery line. The delivery cylinders 90, 95 are driven in opposite stroke movements via hydraulic drive cylinders 7, 8 which are arranged in a first primary circuit I. For this purpose, the drive pistons of the drive cylinders 7, 8 are connected via a common piston rod to the delivery pistons in the delivery cylinders. The drive cylinders 7, 8 form a first consumer in the primary circuit I which, moreover, has a hydraulic drive assembly which comprises at least one motor-driven hydraulic pump 1, 2 (pump 1 being driven by motor M). Furthermore, a secondary circuit II is provided in all exemplary embodiments, which secondary circuit II has a second hydraulic drive assembly which comprises a further motor-driven hydraulic pump 22 (driven by motor M). The hydraulic consumers which are arranged in the primary circuit I and in the secondary circuit II can be loaded in a first operating state via their hydraulic drive assemblies independently from one another with hydraulic oil from a common tank 60. In this way, although the primary circuit I with the drive cylinders 7, 8 and the secondary circuit II with the boom controller 24 can be driven at the same time, they can be driven separately from one another via their respective hydraulic pumps 1, 2, 22.

One special feature of the invention consists in that, in a second operating state when the consumer which comprises the hydraulic cylinders 7, 8 is at a standstill, at least part of the hydraulic oil from the primary circuit I can be fed into the secondary circuit II in order to activate the distributor boom. This measure achieves a situation where the unfolding and folding of the distributor boom which is configured as a folding boom can be carried out more rapidly when the thick matter pump is at a standstill by way of the feed of compressed oil from the primary circuit I. In order to achieve this, the primary circuit I and the secondary circuit II are connected to one another in all exemplary embodiments via a connecting line 29, in which a first control valve 28 (FIG. 1 to 4, 6 to 8) or 35 (FIG. 5) which selectively releases or shuts off the oil flow is arranged. In order to generate the pressure which is required for feeding in in the primary circuit I, various design variants are proposed which will be explained in greater detail in the following text.

The exemplary embodiments according to FIGS. 1 to 6 relate to hydraulic systems, the primary circuit I of which is configured as a closed hydraulic circuit. There, the drive cylinders 7 and 8 which form the consumer are driven by the main lines 17, 18 via a reversible and adjustable main pump 1 in opposite stroke movements. This means that the piston 70 in the drive cylinder 7 extends when the piston 80 in the drive cylinder 8 is pushed back via the oil which flows in the oil oscillation line 19. When both pistons 70, 80 in the drive cylinders 7, 8 have reached their end position, the main pump 1 reverses its delivery direction, with the result that the pistons move in the respectively other direction. From the closed primary circuit I consisting of main pump 1, main lines 17, 18, drive cylinders 7, 8 and oil oscillation line 19, a corresponding oil quantity is always fed out via the scavenging shuttle valve 5 and the pressure limiting valve 6 into the tank 60 which is under atmospheric pressure. Here, the oil quantity to be fed out can be set via the pressure limiting valve 6. The scavenging shuttle valve 5 has two control lines 25, 26 which are connected to the main lines 17 and 18 and push the valve slide of the scavenging shuttle valve 5 to and fro, depending on which side the high pressure prevails. Via the outfeed lines 20 and 21, oil is then fed out via the main line 17 or 18 from the low pressure side to the tank 60. In addition, a feed pump 2 which is connected on the suction side to the tank 60 is provided, via which feed pump 2 an oil quantity which corresponds to the oil quantity which is fed out at the scavenging shuttle valve 5 is fed in again on the low pressure side of the main pump 1 via the non-return valves 3 and 4 which are connected to the main. lines 17 and 18. A possible excess quantity flows via the pressure limiting valve 43 into the tank 60.

If the main pump 1 is at zero delivery, a pressure equilibrium prevails in the lines 17 and 18, with the result that the valve slide of the scavenging shuttle valve 5 remains in the center position and no oil is fed out. In this state, the complete oil quantity of the feed pump 2 flows via the pressure limiting valve 43 into the tank 60.

On account of leaks which occur in the drive cylinders 7 and 8, oil has to be fed in or fed out in certain operating states, in order that the relevant pistons 70, 80 can in each case reach their end positions. If, for example, the piston 80 in the cylinder 8 does not reach its bottom-side end position, whereas the piston 70 in the cylinder 7 has reached its rod-side end position, oil can be fed to the cylinder 8 via the throttle 16, the non-return valve 13 and the oil oscillation line 19, with the result that the piston 80 in the cylinder 8 also reaches its bottom-side end position. If, in contrast, the piston 70 in the cylinder 7 has not yet reached its rod-side end position, whereas the piston 80 in the cylinder 8 is already situated in its bottom-side end position, oil is fed out via the non-return valve 11, with the result that the piston 70 in the cylinder 7 can move into its rod-side end position. Here, the piston end position valve 10 which is configured as a ball cock has to be open. On the side of the cylinder 8, the non-return valve 12 corresponds to the bottom-side non-return valve 11, whereas the piston end position valve 9 there corresponds to the piston end position valve 10. Secondly, the non-return valve 14 on the cylinder 8 corresponds to the rod-side non-return valve 13 on the cylinder 7, whereas the rod-side throttle 16 there corresponds to the throttle 15. The secondary circuit II which is configured as a boom circuit contains a hydraulic pump 22 which can optionally be configured as a fixed displacement pump or as a variable displacement pump. The hydraulic pump 22 is connected on the suction side to the tank 60 and on the pressure side via the pressure line 23 to the consumer which is configured as a boom controller 24.

In the exemplary embodiments according to FIGS. 1 to 4 and 6 to 8, a control valve 28 which is configured as a 2/2-way valve is provided in the connecting line 29 between the primary circuit I and the secondary circuit II. In the rest position, the directional valve 28 shuts off the connection between the primary circuit I and the pressure line 23 in a manner which is free from leakage oil, whereas the connection is opened in the switched position. In order that the pressure which is necessary for the boom controller 24 can be built up by the main pump 1, the main pump 1 is activated in such a way that the pressure side is at the main line 17 in the case of FIG. 1. The piston 70 of the drive cylinder 7 therefore has to be moved there into its rod-side end position. Since, during the feeding to the secondary circuit II (boom circuit), the primary circuit I is opened and the oil which is fed into the secondary circuit II no longer flows back to the main pump 1, only as much oil can be fed in as is replenished by the feed pump 2. The maximum possible quantity can be limited via the electrically proportional (EP) quantity adjusting means 27 of the main pump 1.

Figure 2:
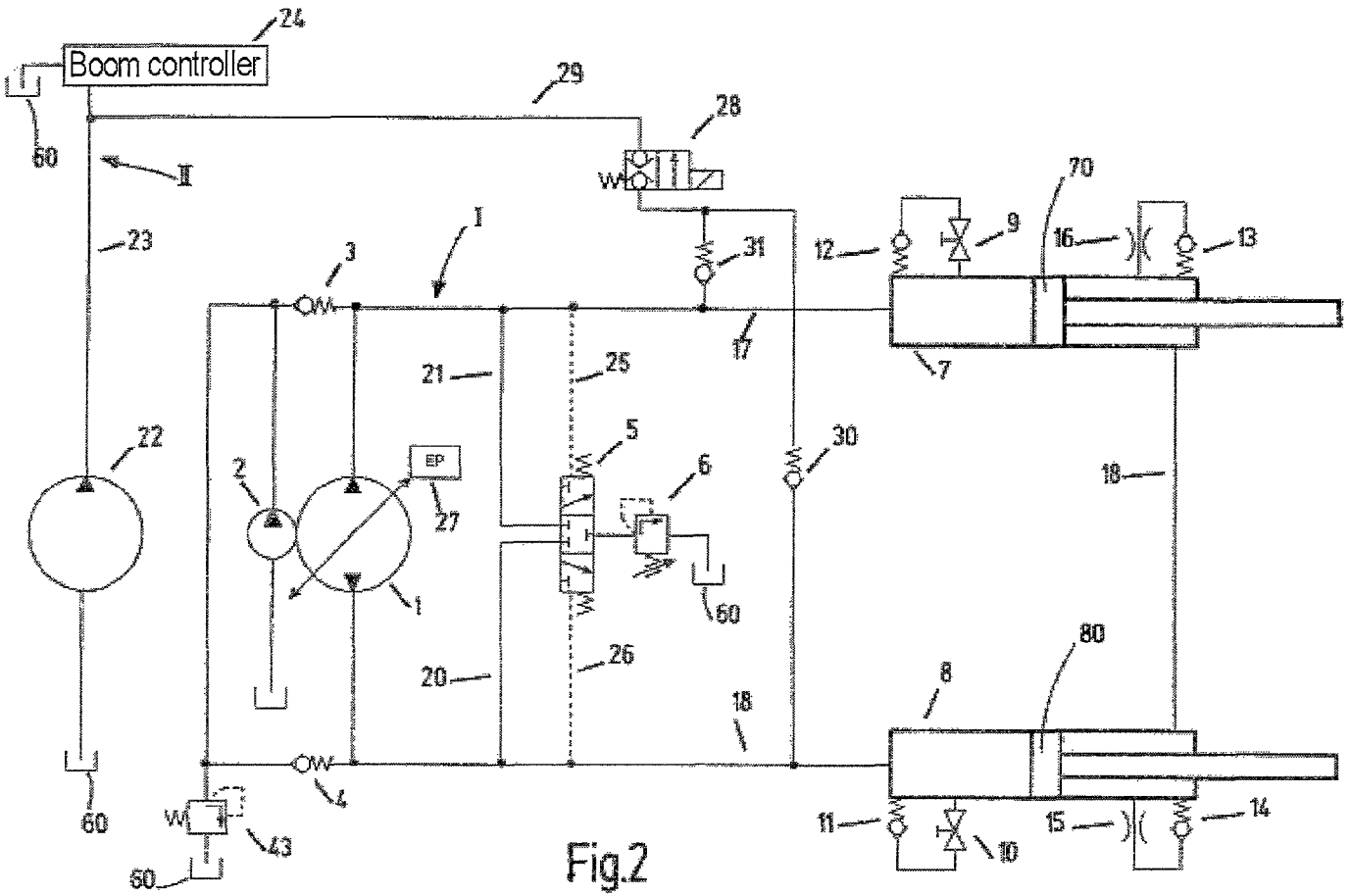

In the exemplary embodiment according to FIG. 2, two additional non-return valves 30 and 31 are provided, via which a connection can be produced from the main line 17 or 18 to the directional valve 28. As a result, the main pump 1 can selectively be activated in such a way that the pressure side lies either at the main line 17 or at the main line 18. If the pressure side is at the main line 18, the piston in the drive cylinder 8 has to be moved into its rod-side end position.

Figure 3:
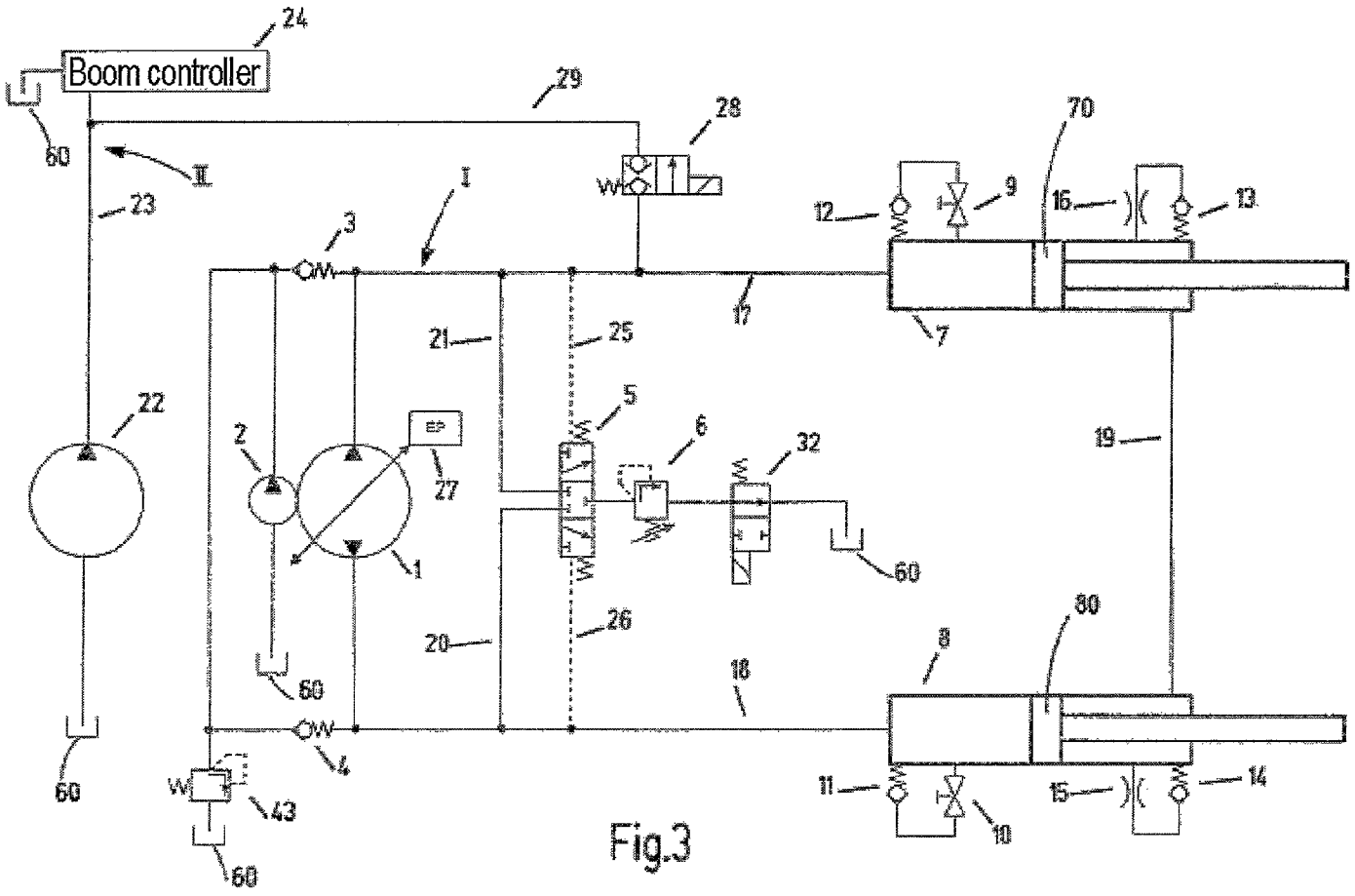

In the exemplary embodiment according to FIG. 3, an additional control valve 32 which is configured as a shut-off valve is provided, which control valve 32 guides the oil which is fed out via the scavenging shuttle valve 5 and the pressure limiting valve 6 to the tank 60 in the non-activated state. In order to feed into the secondary circuit II (boom circuit), the control valve 32 is activated. As a result, the connection to the tank 60 is shut off, with the result that no more oil can be fed out to the tank 60. The complete oil quantity of the feed pump 2 is therefore available via the main pump 1 for feeding into the secondary circuit II.

Figure 4:
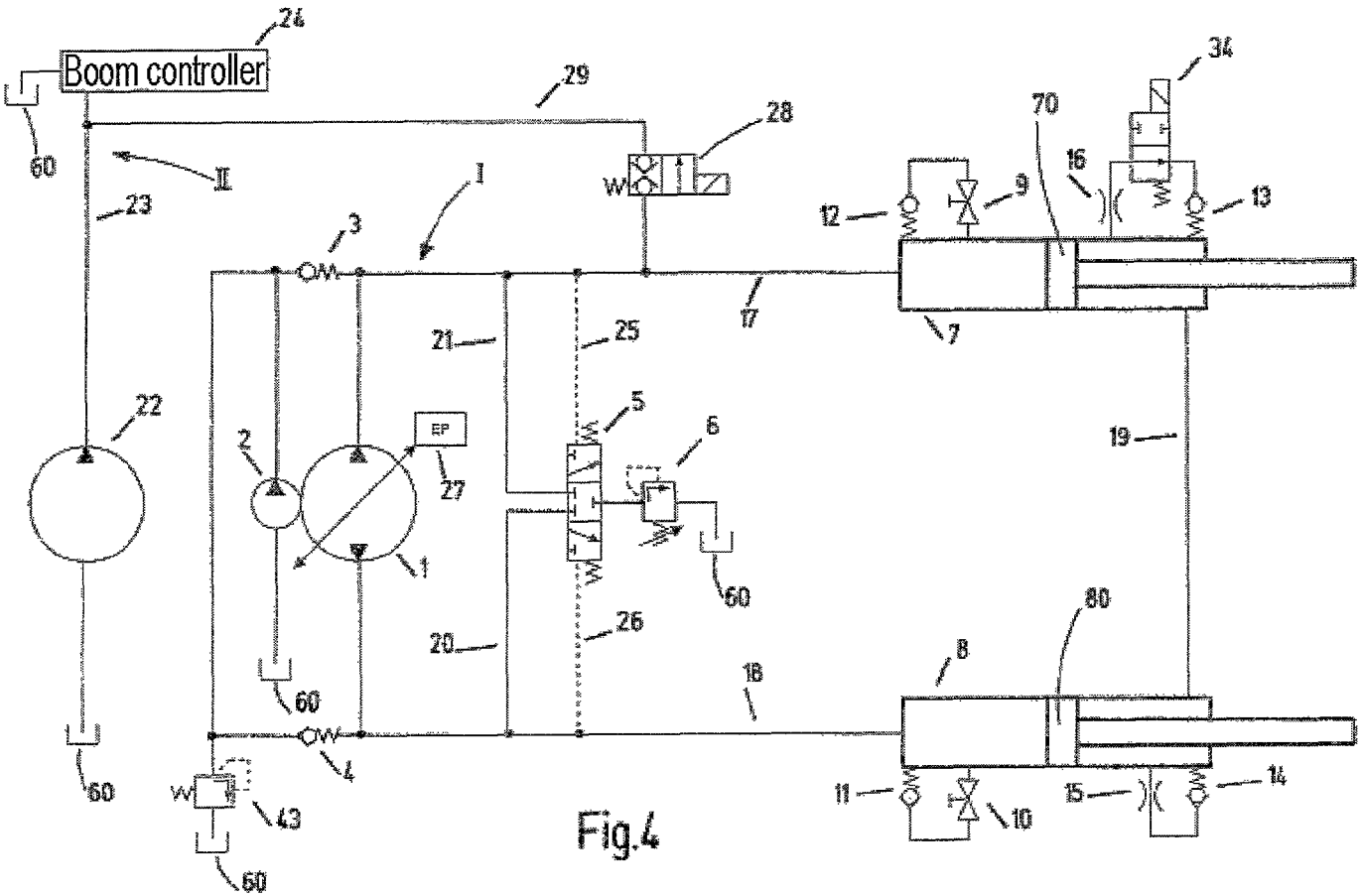

In the case of the exemplary embodiment according to FIG. 4, an additional shut-off valve 34 is provided between the throttle 16 and the non-return valve 13 of the stroke compensation loop. If the piston 70 in the drive cylinder 7 is situated in its rod-side end position and if pressure is built up on account of the feeding into the secondary circuit II (boom circuit), oil flows from the main line 17 via the throttle 16, the connecting line 19 and the non-return valves 13, 11 to the low pressure side 18. This oil is therefore not available for feeding into the boom circuit. The valve 34 is open in the non-activated state. If the valve 34 is activated, no more oil can flow out and the complete oil quantity of the feed pump 2 is available for feeding into the secondary circuit.

In the exemplary embodiment according to FIG. 5, a control valve 35 which is configured as a directional valve is provided as an alternative in the stroke compensation loop of the cylinder 7 instead of the control valve 28. In the non-activated state, oil can flow via the throttle 16 and the non-return valve 13. If the directional valve 35 is activated and the piston 70 in the drive cylinder 7 is situated in its rod-side end position, a connection of the main line 17 is produced via the drive cylinder 7 and the line 29 to the pressure line 23 of the secondary circuit II (boom circuit). At the same time, the outfeed to the low pressure side via the throttle 16 and the non-return valve 13 is shut off. No more oil can therefore flow out, with the result that the complete oil quantity of the feed pump 2 is available for feeding in.

In the case of the exemplary embodiment according to FIG. 6, an additional shut-off valve 33 is provided in the oil oscillation line 19. In the non-activated state, the shut-off valve 33 connects the drive cylinders 7 and 8, with the result that they can carry out the above-described delivery cycle. If the shut-off valve 33 is activated, the connection through the oil oscillation line 19 is shut off, with the result that the pistons 70, 80 can no longer move in the drive cylinders 7, 8. The oil compensation on account of the leakage in the drive cylinders 7, 8 also can no longer take place. As a result, pressure can be built up in the drive cylinders 7, 8 and in the main lines 17, 18 by way of the main pump 1 in any desired position of the pistons 70, 80. The pressure limiting valve 52 which is connected via the non-return valves 53 and 54 to the pressure chambers between the drive cylinders 7, 8 and the shut-off valve 33 prevents impermissibly high pressures in the case of a closed shut-off valve 33, which impermissibly high pressures might occur on account of the pressure intensification in the drive cylinders 7, 8.

In each case one open primary circuit I is provided for driving the concrete pump in the exemplary embodiments according to FIGS. 7 and 8. In the case of FIG. 7, the main pump 44 sucks the oil via the suction line 48 directly from the tank 60. A reversing valve 36 is situated between the main line 47 and the work lines 17' and 18', which reversing valve 36 selectively connects the main line 47 to the work line 17' or 18' and the non-connected line 18' or 17' to the tank 60. The pistons 70, 80 in the drive cylinders 7 and 8 then move in opposite stroke movements as described above. In order to reverse the direction of movement, the reversing valve 36 is activated in the opposite direction. The main pump 44 has an electrically proportional (EP) adjusting device 45. If, in the case of FIG. 7, hydraulic oil is to be fed into the secondary circuit II (boom circuit), the valve 36 is not activated. The connection of the main line 47 to the work lines 17', 18' is therefore shut off. If the directional valve 28 is then activated, oil can be fed via the main line 47 and the line 29 from the primary circuit I to the secondary circuit II. Here, the complete delivery volume of the main pump 44 can theoretically be fed into the secondary circuit II. In practice, the oil quantity which is fed in is set via the electrically proportional quantity adjusting means 45.

In the exemplary embodiment according to FIG. 8, as an alternative both the boom pump 22 is LS (load sensing) regulated by way of regulator 37 and the main pump 44 by way of regulator 46. Here, a directional valve 38 is provided, via which the load pressure of the drive cylinders 7, 8 which is signaled via the line 41 or the load pressure of the boom controller which is signaled via the line 42 is fed selectively to the load sensing regulator (LS) 46 of the main pump 44. In the case of LS-regulated hydraulic pumps, the high pressure of the hydraulic pump is compared with the load pressure and the difference of the two pressures is kept constant via an adjusting member. The adjusting member ensures that the oil quantity is independent of the load pressure. The load pressure of the drive cylinders 7, 8 is tapped off selectively by the work line 17' or 18' via the shuttle valve 37. If the directional valve 38 is not activated, the load pressure of the drive cylinders 7 and 8 passes to the regulator 46 of the main pump 44. Said regulator 46 regulates the pressure difference at the adjustment throttle 50, by way of which the speed of the pistons 70, 80 in the drive cylinders 7 and 8 can be set in a manner which is independent of the load pressure. If hydraulic oil from the primary circuit I is to be fed into the secondary circuit II, the load pressure of the boom controller is signaled to the regulator 46 of the main pump 44 by way of activation of the valve 38 via the line 42. Said regulator 46 regulates the pressure difference at the adjustment throttle 51 in a manner which is independent of the load pressure, by way of which adjustment throttle 51 the quantity of hydraulic oil which is fed in can be set.

In the above text, the invention has been described in detail for the application case of a mobile two-cylinder thick matter pump. It is possible in principle to also transfer the principle on which the invention is based to other hydraulic systems having at least two hydraulic circuits, as occur, for example, in excavators or other work machines.

In summary, the following is to be noted: the invention relates to a hydraulic system, preferably for activating and actuating a mobile thick matter pump. The hydraulic system comprises a primary circuit I which activates a first hydraulic consumer and has a hydraulic drive assembly which comprises at least one motor-driven hydraulic pump 1, 2, 44. Furthermore, a secondary circuit II is provided which activates a second hydraulic consumer and has a second hydraulic drive assembly which comprises at least one further motor-driven hydraulic pump 22. The hydraulic consumers 7, 8; 24 which are arranged in the primary circuit I and in the secondary circuit II can be loaded in a first operating state via their hydraulic drive assemblies independently of one another with hydraulic oil from a common tank 60. One special feature of the invention consists in that, in a second operating state when the first consumer 7, 8 is at a standstill, at least part of the hydraulic oil from the primary circuit I is fed into the secondary circuit II in order to activate the second consumer 24. The first consumer 7, 8 which is arranged in the primary circuit I is advantageously configured as a hydraulic drive mechanism of the thick matter pump, whereas the second consumer 24 which is arranged in the secondary circuit II is configured as a drive and control mechanism of a distributor boom which consists of a plurality of boom arms.

LIST OF DESIGNATIONS

1 Main pump (hydraulic pump)
2 Feed pump (hydraulic pump)
3 Non-return valve
4 Non-return valve
5 Scavenging shuttle valve
6 Pressure limiting valve
7 Drive cylinder
8 Drive cylinder
9, 10 Piston end position valve
11, 12 Non-return valve
13, 14 Non-return valve
15, 16 Throttle
17 Main line
18 Main line
17' Work line
18' Work line
19 Oil oscillation line
20 Outfeed line
21 Outfeed line
22 Boom pump (hydraulic pump)
23 Pressure line
24 Boom controller
25 Control line
26 Control line
27 Quantity adjusting means
28 Control valve (2/2-way valve)
29 Connecting line
30 Non-return valve
31 Non-return valve
32 Control valve
33 Shut-off valve
34 Shut-off valve
35 Control valve
36 Reversing valve
37 Shuttle valve
38 Directional valve
41 Line
42 Line
43 Pressure limiting valve
44 Main pump (hydraulic pump)
45 Adjusting device (quantity adjusting means)
46 Load sensing regulator (LS)
47 Main line
48 Suction line
50 Adjustment throttle
51 Adjustment throttle
52 Pressure limiting valve
53 Non-return valve
54 Non-return valve
60 Tank
70 Piston
80 Piston
I Primary circuit
II Secondary circuit

The invention claimed is:

1. A hydraulic system having a primary circuit which activates a first hydraulic consumer and has a first hydraulic drive assembly which comprises at least one motor-driven hydraulic pump, the first hydraulic consumer being configured as a hydraulic drive mechanism of a thick matter pump, having a secondary circuit which activates a second hydraulic consumer and has a second hydraulic drive assembly which comprises at least one further motor-driven hydraulic pump, the second consumer being configured as a drive and control mechanism of a distributor boom of the thick matter pump, the distributor boom comprising a plurality of boom arms, wherein the hydraulic consumers which are arranged in the primary circuit and in the secondary circuit are loaded in a first operating state via their hydraulic drive assemblies independently of one another with hydraulic oil from a tank, wherein in a second operating state, when the first consumer is at a standstill and the hydraulic pumps of the first and second hydraulic drive assemblies are operated, at least part of the hydraulic oil from the primary circuit is fed into the secondary circuit in order to activate the distributor boom such that unfolding and folding of the distributor boom can be carried out more rapidly, wherein the hydraulic drive mechanism of the thick matter pump has first and second hydraulic drive cylinders which are connected via first and second piston rods, respectively, to first and second delivery cylinders, respectively, and are connected at their one end via first and second main lines, respectively, to the at least one hydraulic pump which is arranged in the primary circuit and are connected at their other end via an oil oscillation line to one another, wherein the primary circuit and the secondary circuit are connected to one another via a connecting line, in which a first control valve which selectively releases or shuts off an oil flow is arranged, and wherein the at least one motor-driven hydraulic pump comprises a reversible and adjustable main pump and a feed pump which opens on a pressure side into the primary circuit and on a suction side into the tank are arranged in the primary circuit.

2. The hydraulic system as claimed in claim 1, wherein at least one second control valve which selectively shuts off or releases the oil flow to the tank is arranged within the primary circuit.

3. The hydraulic system as claimed in claim 1, wherein at least one additional control valve which selectively shuts off or releases the oil flow to, from or between the first and second hydraulic drive cylinders is arranged within the primary circuit.

4. The hydraulic system as claimed in claim 1, wherein the connecting line which contains the control valve is branched off from one of the main lines of the primary circuit.

5. The hydraulic system as claimed in claim 1, wherein the connecting line which contains the control valve is connected via a first non-return valve to the first main line of the primary circuit and via a second non-return valve to the second main line.

6. The hydraulic system as claimed in claim 1, wherein an additional control valve which releases or shuts off through-flow is arranged in the oil oscillation line between the first and second hydraulic drive cylinders.

7. A hydraulic system having a primary circuit which activates a first hydraulic consumer and has a first hydraulic drive assembly which comprises at least one motor-driven hydraulic pump, the first hydraulic consumer being configured as a hydraulic drive mechanism of a thick matter pump, having a secondary circuit which activates a second hydraulic consumer and has a second hydraulic drive assembly which comprises at least one further motor-driven hydraulic pump, the second consumer being configured as a drive and control mechanism of a distributor boom of the thick matter pump, the distributor boom comprising a plurality of boom arms, wherein the hydraulic consumers which are arranged in the primary circuit and in the secondary circuit are loaded in a first operating state via their hydraulic drive assemblies independently of one another with hydraulic oil from a tank, wherein in a second operating state, when the first consumer is at a standstill and the hydraulic pumps of the first and second hydraulic drive assemblies are operated, at least part of the hydraulic oil from the primary circuit is fed into the secondary circuit in order to activate the distributor boom such that unfolding and folding of the distributor boom can be carried out more rapidly, wherein the hydraulic drive mechanism of the thick matter pump has first and second hydraulic drive cylinders which are connected via first and second piston rods, respectively, to first and second delivery cylinders, respectively, and are connected at their one end via first and second main lines, respectively, to the at least one hydraulic pump which is arranged in the primary circuit and are connected at their other end via an oil oscillation line to one another, wherein the primary circuit and the secondary circuit are connected to one another via a connecting line, in which a first control valve which selectively releases or shuts off an oil flow is arranged, wherein stroke compensation loops which are fitted with infeed and outfeed valves are arranged in a region of end positions of pistons in the drive cylinders, and wherein a control valve which is configured as a shut-off valve or a directional valve which can be connected selectively to the secondary circuit is arranged in at least one of the stroke compensation loops.

* * * * *